US007926891B2

(12) United States Patent
Ritter

(10) Patent No.: US 7,926,891 B2
(45) Date of Patent: Apr. 19, 2011

(54) SUPPORT CONSTRUCTION FOR AT LEAST ONE FURNITURE DRIVE

(75) Inventor: Thomas Ritter, Lustenau (AT)

(73) Assignee: Julius Blum GmbH, Höchst (AT)

( * ) Notice: Subject to any disclaimer, the term of this patent is extended or adjusted under 35 U.S.C. 154(b) by 179 days.

(21) Appl. No.: 12/289,458

(22) Filed: Oct. 28, 2008

(65) Prior Publication Data

US 2009/0127992 A1 May 21, 2009

(30) Foreign Application Priority Data

Nov. 19, 2007 (AT) ..... A 1868/2007

(51) Int. Cl.
*A47B 95/02* (2006.01)

(52) U.S. Cl. ..... 312/319.5; 312/334.7; 312/351

(58) Field of Classification Search ..... 312/319.1, 312/319.5, 330.1, 334.1, 334.7, 351
See application file for complete search history.

(56) References Cited

U.S. PATENT DOCUMENTS

| | | | | |
|---|---|---|---|---|
| 6,039,422 | A * | 3/2000 | Butters et al. | 312/334.1 |
| 6,442,030 | B1 | 8/2002 | Mammoser et al. | |
| 6,497,185 | B1 * | 12/2002 | Barrett et al. | 108/108 |
| 6,866,352 | B2 * | 3/2005 | Fujii et al. | 312/122 |
| 7,258,568 | B2 * | 8/2007 | Shih | 439/377 |
| 7,554,819 | B2 * | 6/2009 | Chen et al. | 361/826 |
| 2003/0160552 | A1 * | 8/2003 | Bacho et al. | 312/334.5 |
| 2007/0080612 | A1 * | 4/2007 | Terazono et al. | 310/366 |
| 2007/0180654 | A1 * | 8/2007 | Gasser | 16/242 |
| 2009/0039745 | A1 * | 2/2009 | Wong | 312/333 |
| 2009/0212678 | A1 * | 8/2009 | Sung | 312/333 |

FOREIGN PATENT DOCUMENTS

| | | | | |
|---|---|---|---|---|
| DE | 600 12 556 | | 9/2005 | |
| DE | 10 2005 021 565 | | 11/2006 | |
| DE | 20 2006 006 187 | | 10/2007 | |
| EP | 523424 | * | 1/1993 | 312/334.1 |
| WO | 01/21040 | | 3/2001 | |
| WO | 2006/017864 | | 2/2006 | |
| WO | 2006/017865 | | 2/2006 | |

OTHER PUBLICATIONS

Austrian Search Report issued May 16, 2008.

* cited by examiner

*Primary Examiner* — Hanh V Tran
(74) *Attorney, Agent, or Firm* — Wenderoth, Lind & Ponack, L.L.P.

(57) ABSTRACT

A support construction is provided for fixing at least one furniture drive for a movable furniture part in a furniture body. The support construction includes two lateral holding portions and a transverse bearer extending between the holding portions. The holding portions have fixing means for preferably releasably fixing the holding portions to a respective pull-out-guide assembly.

19 Claims, 8 Drawing Sheets

6b
1
6a
6
3c
9
4
3a
4a
5
6b
3b
7
3

SUPPORT CONSTRUCTION FOR AT LEAST ONE FURNITURE DRIVE

BACKGROUND OF THE INVENTION

The present invention relates to a support construction for fixing at least one furniture drive for driving a movable furniture part in a furniture body, wherein the support construction comprises two lateral holding portions and a transverse bearer extending between these holding portions.

Furthermore the invention relates to a furniture item comprising a support construction of the kind to be described.

Support constructions for mounting a furniture drive are used in particular in connection with furniture items in cupboard form having one or more drawers for moving the drawer by means of the furniture drive from a closed position into an open position. For that purpose, the furniture drive is arranged in the immediate proximity of the rear wall of the respective drawer. An ejection element acts on the rear wall of the drawer so that the drawer, starting from a closed position, is urged into an open position. For that purpose, stable mounting for the respective furniture drive is required. In many cases, however, the furniture body does not have a stable rear wall for mounting the furniture drive, so that the use of a transverse bearer or a support rail for mounting the furniture drive has proven to be beneficial. The transverse bearer or the support rail however has to be arranged at a defined distance relative to the rear wall of the drawer, particularly when the furniture drive is equipped with a Touch-Latch-Functionality. With such a Touch-Latch-Functionality, the drawer, in the closed condition, can be moved into a limit position which is situated further into the furniture body when manual pressure is applied to the front panel of the drawer, whereupon the Touch-Latch function of the furniture drive is activated and the drawer is ejected into an open position. For that purpose, a defined release path is required to activate the Touch-Latch function, and that presupposes that the furniture drive is arranged in a correct position with respect to the rear wall of the drawer.

SUMMARY OF THE INVENTION

It is therefore an object of the present invention to provide for convenient and precise mounting of the support construction at or in a furniture item.

In a preferred embodiment according to the present invention, the holding portions comprise fixing means for—preferably releasably—fixing the holding portions to a pull-out-guide assembly for drawers.

In that way, it is possible for the holding portions to be fixed to a, preferably stationary, portion of the pull-out-guide assembly (which have already been pre-assembled to the furniture body) and then for the transverse bearer (on or at which at least one furniture drive for ejection of the drawer can be mounted) to be connected to the holding portions. The portion for securing the holding portions to the pull-out-guide assembly is selected such that it predetermines a defined position for the furniture drive having a Touch-Latch functionality. Thereby, it is possible to obtain a defined release path for the Touch-Latch function in order to properly eject the drawer from a closed position. In that way the furniture drive can always be arranged in a precise position with respect to the rear wall of the drawer.

A preferred embodiment provides that the pull-out-guide assembly comprises a carcass rail to be mounted to the furniture body and at least one extension rail adapted to be mounted to a drawer, wherein the holding portions can be connected to the stationary carcass rail. The holding portions—when being mounted—can be connected to rear ends of the carcass rail. In that way, the transverse bearer to be mounted can always be fixed in an accurate position even when using pull-out-guide assemblies of different nominal length.

For fixing the holding portions to the extension rails, the fixing means can have a screw connection and/or a mechanical latching connection for connection to the pull-out-guide assembly for drawers.

A further embodiment of the invention provides that the holding portions can be made integral in one piece with the pull-out-guide assembly, preferably in one piece with the carcass rail thereof.

A further embodiment of the invention provides that the holding portions can be connected with the transverse bearer by a snap-action connection means. The detachable connection of the transverse bearer to the holding portions makes it possible for the transverse bearer to be subsequently connected to the holding portions which have already been pre-assembled. In that context, it may be desirable if the holding portions have a lateral portion for fixing to the pull-out-guide assembly and a transverse portion projecting substantially at a right angle from the lateral portion for connection to the transverse bearer.

BRIEF DESCRIPTION OF THE DRAWINGS

Further details and advantages of the present invention will now be described with the aid of the figures in the attached drawings, wherein.

DETAILED DESCRIPTION OF THE INVENTION

Figure 1:
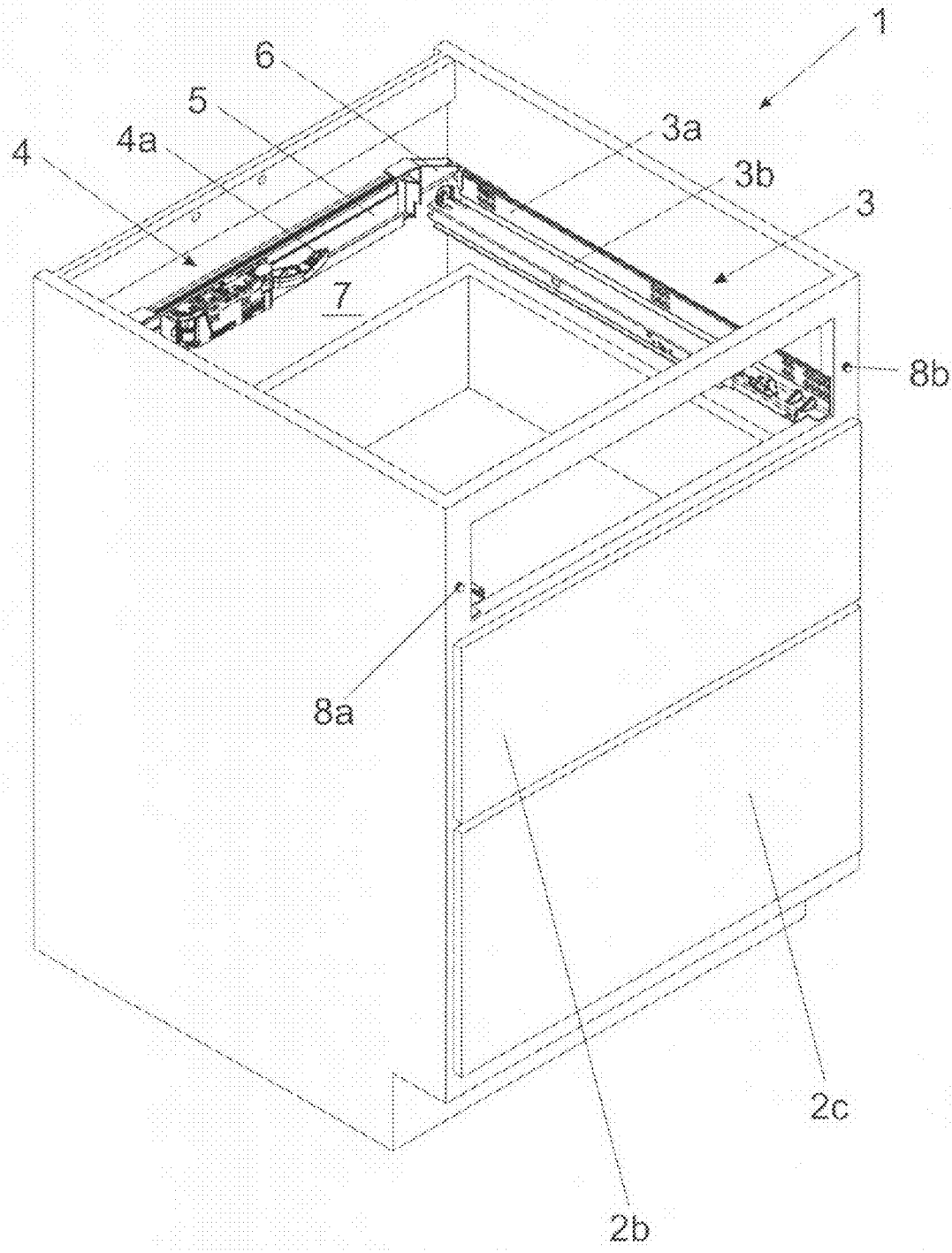
FIG. 1 is a perspective view of a furniture item in cupboard form with a support construction according to the invention for mounting a Touch-Latch furniture drive in an accurate position.

FIG. 1 shows a perspective view of a furniture item 1 in cupboard form, with displaceable drawers 2*b* and 2*c*, the uppermost drawer 2*a* having been removed for the sake of enhanced clarity of the drawing. Provided at both sides of the respective drawers 2*b* and 2*c* are pull-out-guide assemblies 3 for displacing the drawers 2*b*, 2*c*, said pull-out-guide assemblies 3 comprise a stationary carcass rail 3*a* and at least one extension rail 3*b* which is displaceable relative to the carcass rail 3*a*. A furniture drive 4 with an ejection element 4*a* is depicted, by means of which a drawer associated with the ejection element 4*a* can be moved from the closed position into an open position when manually applying a pushing force or a pulling force to the front panel of the drawer 2*b*, 2*c*. The furniture drive 4 is therefore preferably equipped with a Touch-Latch functionality, wherein the ejection element 4*a* in the form of a pivotally mounted lever presses against the rear wall of the respective drawer 2*a*, 2*b*, 2*c*. In the case of the Touch-Latch ejection devices, therefore, a defined release path is required for activation of the Touch-Latch function, which presupposes that the furniture drive 4 is in a correct position with respect to the rear wall of the respective drawer 2*b*, 2*c*. To ensure a defined release path for ejecting the drawer 2*b*, 2*c* it is proposed that the furniture drive 4 is fixed to a transverse bearer 5 which in turn is fixed by way of lateral holding portions 6 to the pull-out-guide assembly 3, preferably at a rearward end of the carcass rail 3*a*. In that way, the transverse bearer 5 (and therewith the furniture drive 4) can always be mounted at the correct location, particularly when the pull-out-guide assemblies 3 are of different nominal lengths, so as to guarantee the required release path for activation of the Touch-Latch function. That manner of mounting is particularly advantageous even when the rear side 7 of the furniture item 1 is either in the form of a relatively unstable hard fiberboard or in accordance with a further embodiment is not present at all. In the illustrated embodiment, the pull-out-guide assemblies 3 are mounted between the front of the furniture item 1 and the rear side 7, to which the pull-out-guide assemblies 3 are fixed by way of an angled holding member. It will be appreciated that the pull-out-guide assemblies 3 can also be fixed at the inside of mutually opposite side walls of the furniture item 1. In addition, to ensure a defined push-in stroke movement of the drawers 2*b*, 2*c*, spring buffers 8*a*, 8*b* which are known in accordance with the state of the art operate between the rear side of the front panels of the drawers 2*b*, 2*c* and the front side of the body or carcass of the furniture item 1.

Figure 2:
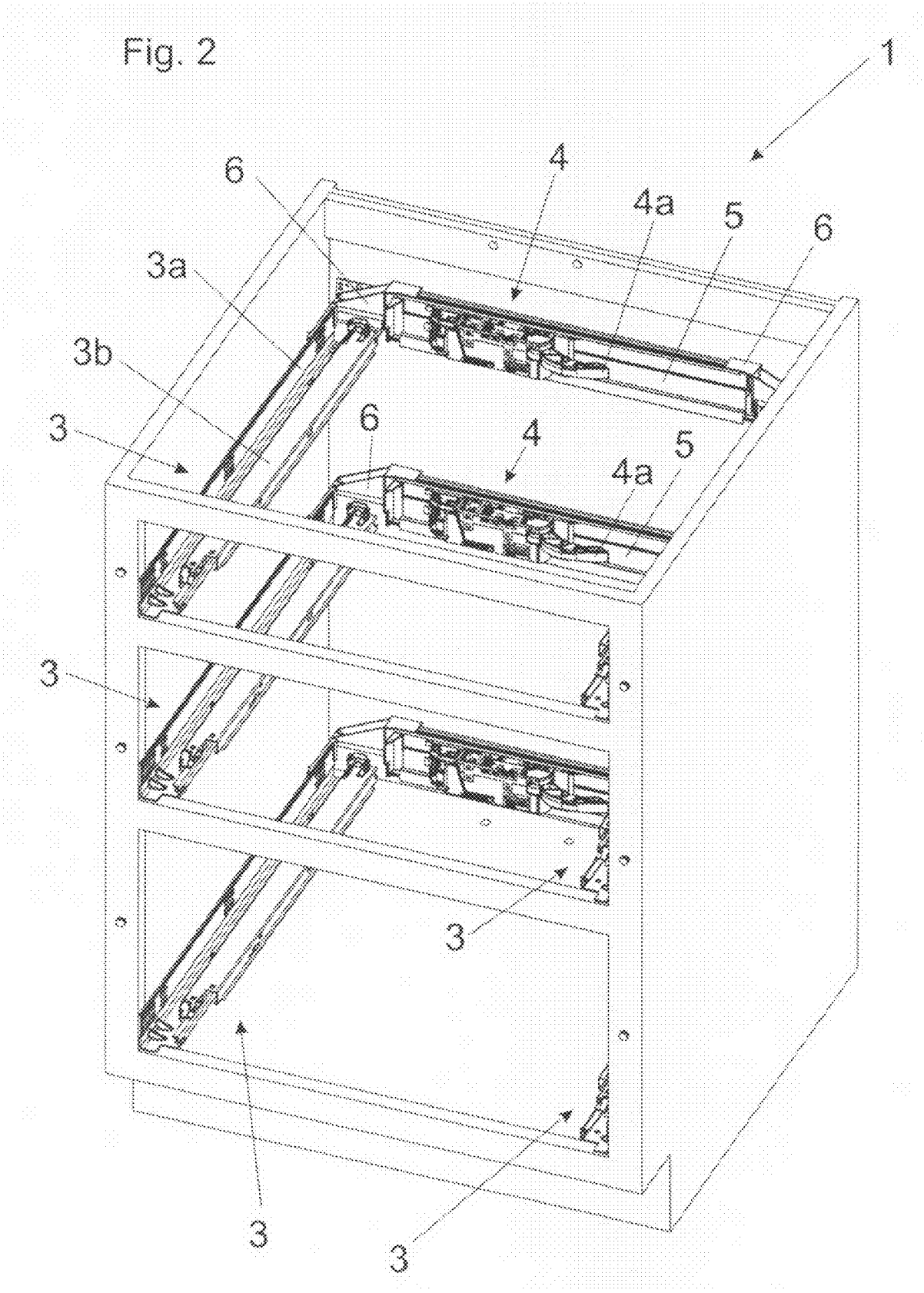
FIG. 2 shows the furniture item of FIG. 1, all drawers having been removed.

FIG. 2 shows a perspective view of the furniture item 1 of FIG. 1, with all drawers 2*b*, 2*c* having been removed. It is possible to see the pull-out-guide assemblies 3, identical parts being denoted by the same references. The pull-out-guide assemblies 3 each have a stationary carcass rail 3*a*, and at least one extension rail 3*b* displaceable relative thereto. Fixed at the rear ends of two oppositely disposed pull-out-guide assemblies 3 are holding portions 6, between which a transverse bearer 5 extends. The transverse bearer 5 is in engagement with both lateral holding portions 6 by way of a snap-action connection so that in a first assembly step the pull-out-guide assemblies 3 are fixed at or in the furniture item 1, in a second assembly step the holding portions 6 are secured to the carcass rails 3*a* and in a subsequent assembly step the transverse bearer 5, with the furniture drive 4 mounted thereon, can be snap-fitted onto the holding portions 6. In the illustrated embodiment, a transverse bearer 5 with a furniture drive 4 is associated with each drawer 2*b*, 2*c*, wherein the respective ejection element 4*a* can be pressed against the rear wall, associated therewith, of the respective drawer 2*b*, 2*c*.

Figure 3:
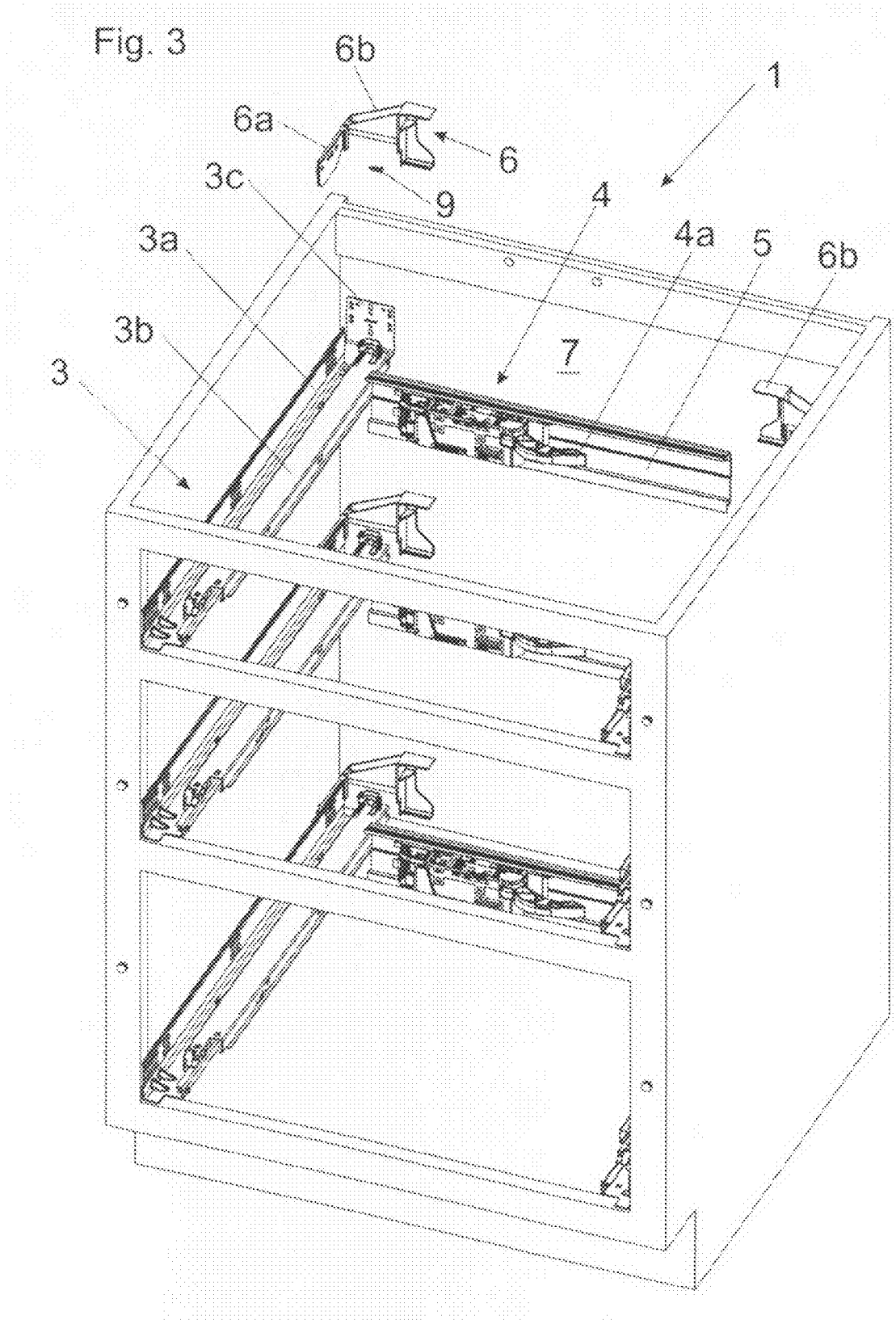
FIG. 3 shows the support construction with lateral holding portions and the transverse bearer for mounting the furniture drive.

FIG. 3 shows the assembled pull-out-guide assemblies 3 with the carcass rail 3*a* and the displaceable extension rail 3*b*. The pull-out-guide assemblies 3 are fixed to the rear side 7 by way of angled holding members 3*c*. It is possible to see the support construction in an exploded view. The lateral holding portions 6 have a lateral portion 6*a* for fixing to the pull-out-guide assemblies 3 and a transverse portion 6*b* projecting substantially at a right angle from the lateral portion 6*a* for fixing the lateral holding portion 6 to the transverse bearer 5. The holding portion 6 can preferably have on its transverse portion 6*b* a latching arrangement for compensating for width tolerances in the transverse bearer 5 in relation to the body or carcass of the furniture item. The holding portion 6 can either be latched to the pull-out-guide assemblies 3 or—as shown in the Figure—fixed to the carcass rail 3*a* by a screw connection 9.

Figure 4A:
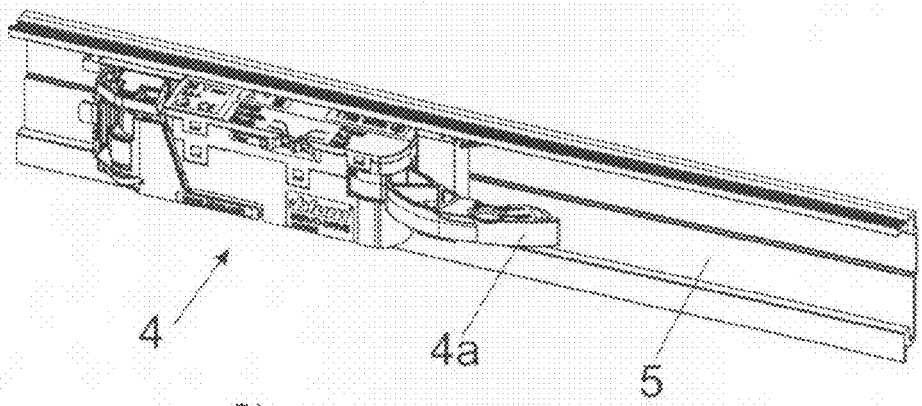
FIG. 4*a*-FIG. 4*c* show various views of the support construction.
Figure 4B:
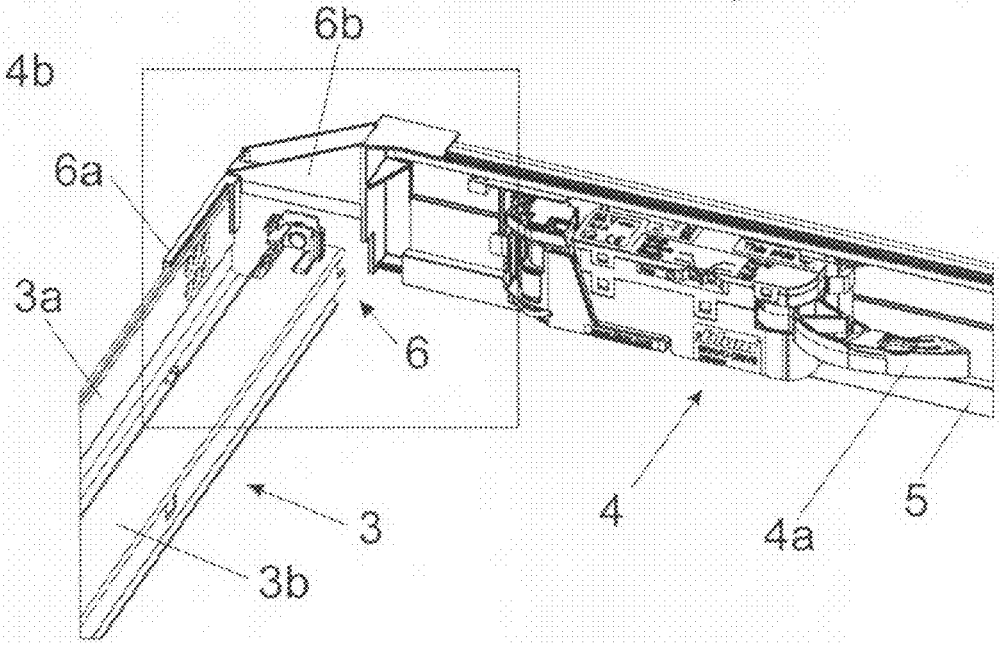
Figure 4C:
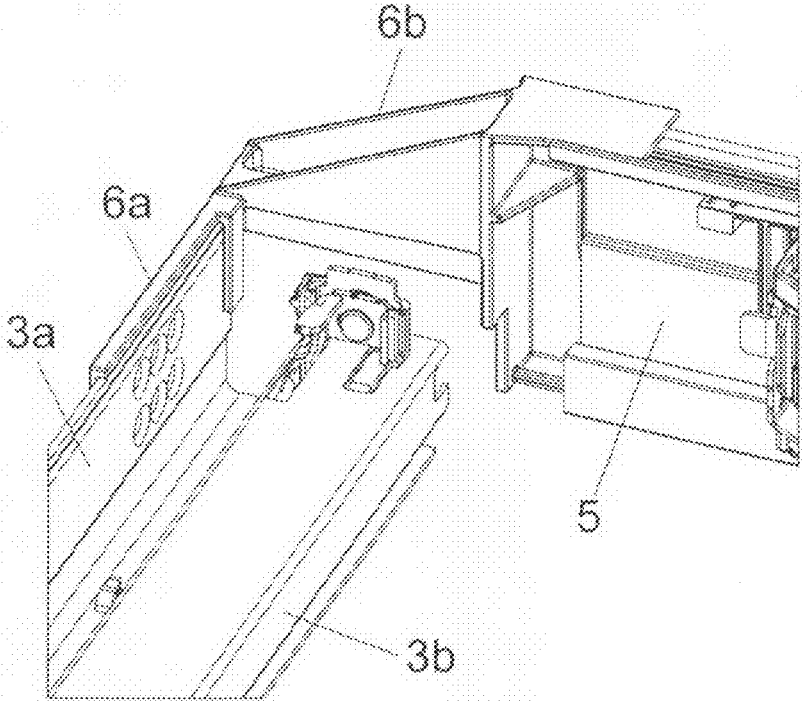

FIG. 4*a* shows the transverse bearer 5 which is in the form of a profile rail and to which a furniture drive 4 with a pivotally mounted ejection element 4*a* for ejection of the respective drawer 2*b*, 2*c* is fitted by snap engagement. FIG. 4*b* shows the pull-out-guide assembly 3 with the carcass rail 3*a* and the extension rail 3*b*, and the holding portion 6 with its lateral portion 6*b* for releasable fixing of the transverse bearer 5 can also be seen. FIG. 4*c* shows a view on an enlarged scale of the region identified in FIG. 4*b*.

Figure 5:
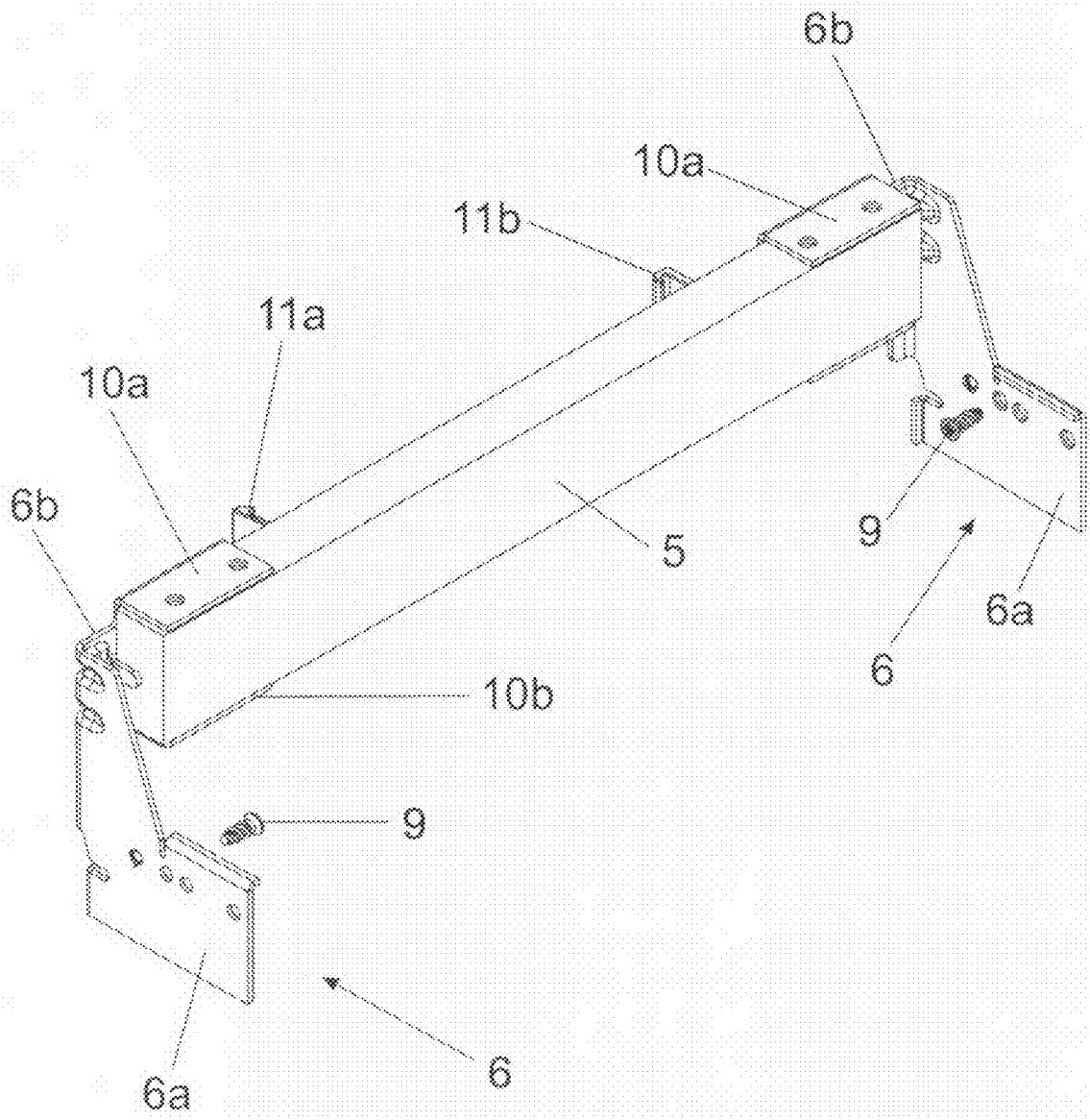
FIG. 5 shows a further embodiment of the invention with a wooden transverse bearer.

FIG. 5 shows a further embodiment of the invention, the lateral holding portions 6 being of a different configuration. The holding portions 6 include a lateral portion 6*a* for fixing to the carcass rail 3*a* by means of the screws 9 and transverse portion 6*b* projecting at a right angle therefrom for connection to the transverse bearer 5. In the illustrated embodiment, the transverse bearer 5 is in the form of a wooden bar fixed to fixing arms 10*a*, 10*b* of the holding portions 6. The furniture drive 4 (not shown here) can either be arranged directly on that wooden transverse bearer 5 or also on a carrier rail fixed perpendicularly with respect to the transverse bearer 5. In this case, the carrier rail can be mounted to the transverse bearer 5 by holding means 11*a*, 11*b*.

Figure 6:
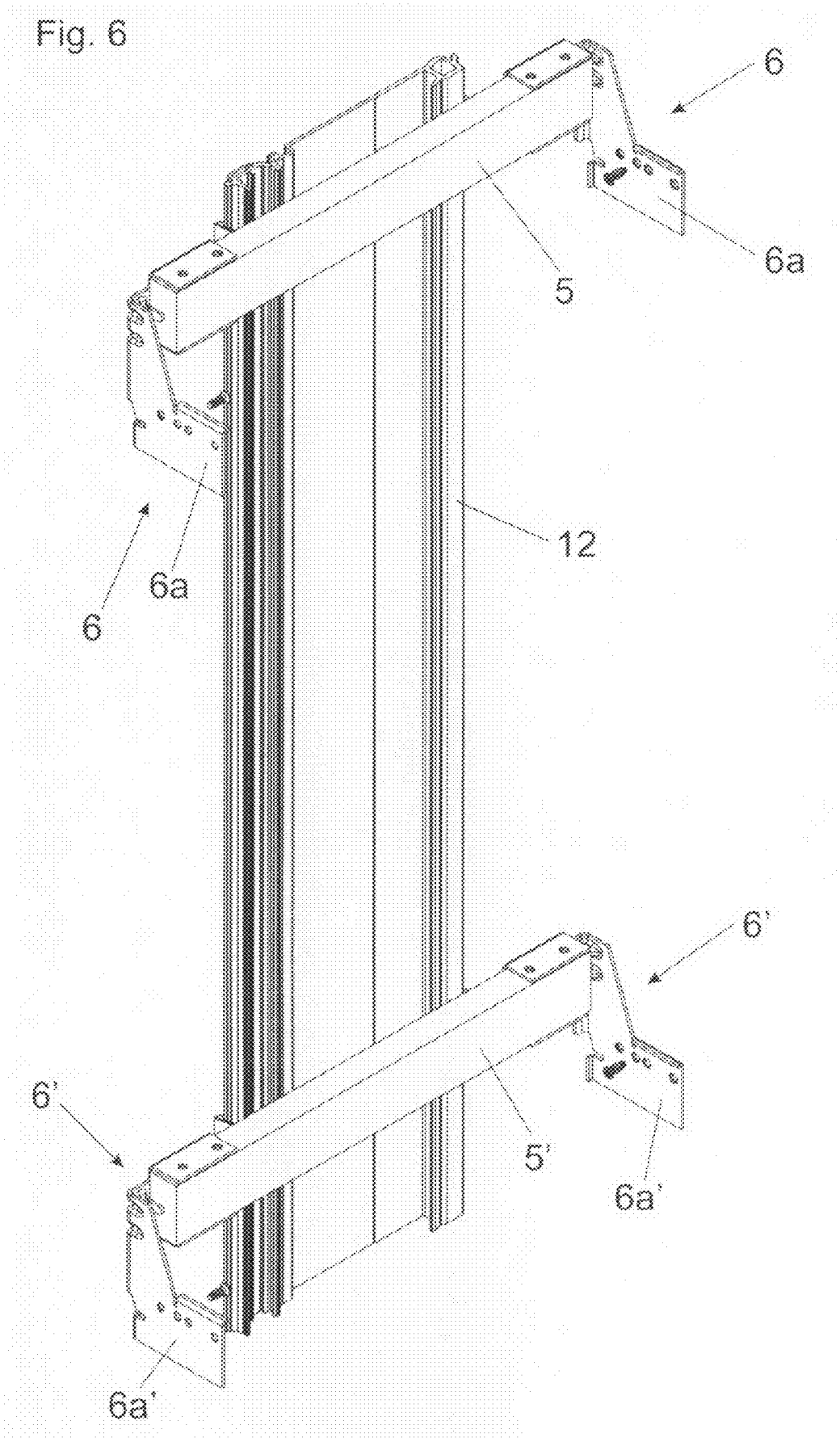
FIG. 6 shows a fixing option with a transverse bearer to be mounted in the upper region of the cupboard and a transverse bearer to be mounted in the lower region of the cupboard, and a carrier rail for mounting the furniture drives.

FIG. 6 shows an upper transverse bearer 5 which is fixed to the uppermost pull-out-guide assemblies 3 in the furniture item 1 in cupboard form, by means of lateral portions 6*a* on the holding portions 6. In a similar fashion, a lower transverse bearer 5' is mounted to the lowermost pull-out-guide assemblies 3 in the furniture item 1 by means of lateral portions 6*a*' of the holding portions 6'. A carrier rail 12 arranged perpendicularly in the assembled position extends between the two transverse bearers 5 and 5', in which case the respective furniture drives 4 for ejection of the drawers 4*b*, 4*c* can be mounted on that carrier rail 12.

Figure 7A:
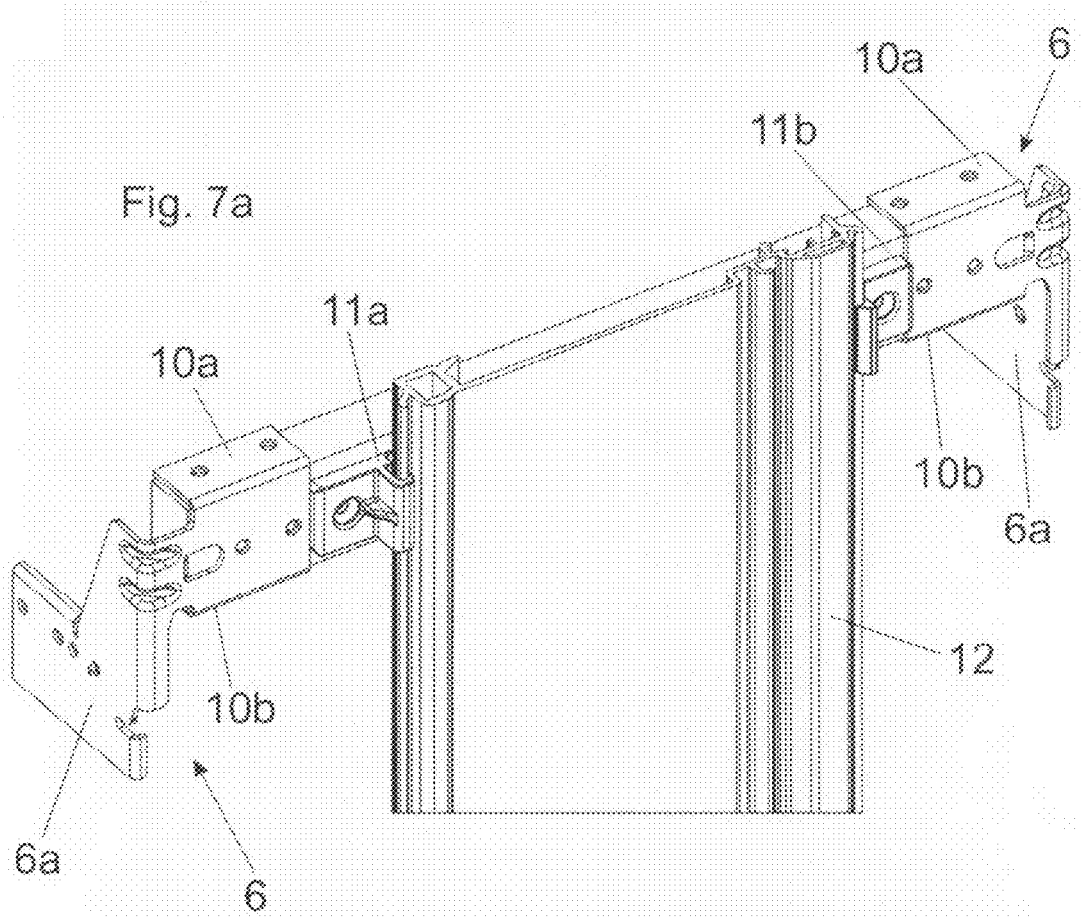
FIG. 7*a* and FIG. 7*b* show perspective rear views of the transverse bearer of FIG. 6 with the carrier rail clipped in place and removed respectively.
Figure 7B:
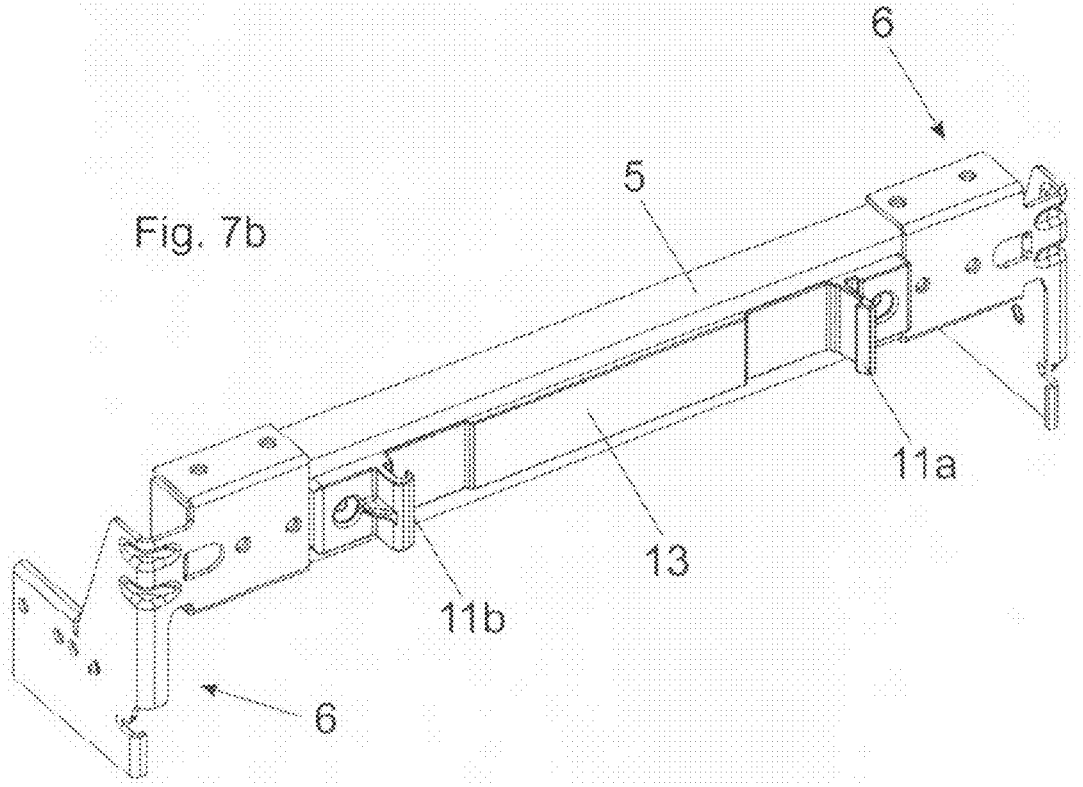

FIG. 7*a* shows the uppermost transverse bearer 5 of FIG. 6, as a perspective rear view. The lateral portions 6*a* of the holding portions 6 are connected to the respective pull-out-guide assemblies 3, in particular to the carcass rail 3*a*. The fixing arms 10*a*, 10*b* fix the wooden transverse bearer 5. Provided at the rear side of the transverse bearer 5 are holding means 11*a*, 11*b* for detachably latching the vertical carrier rail 12. FIG. 7*b* shows a view similar to FIG. 7*a*, with removal of the carrier rail 12 for mounting the furniture drives 4.

Figure 8:
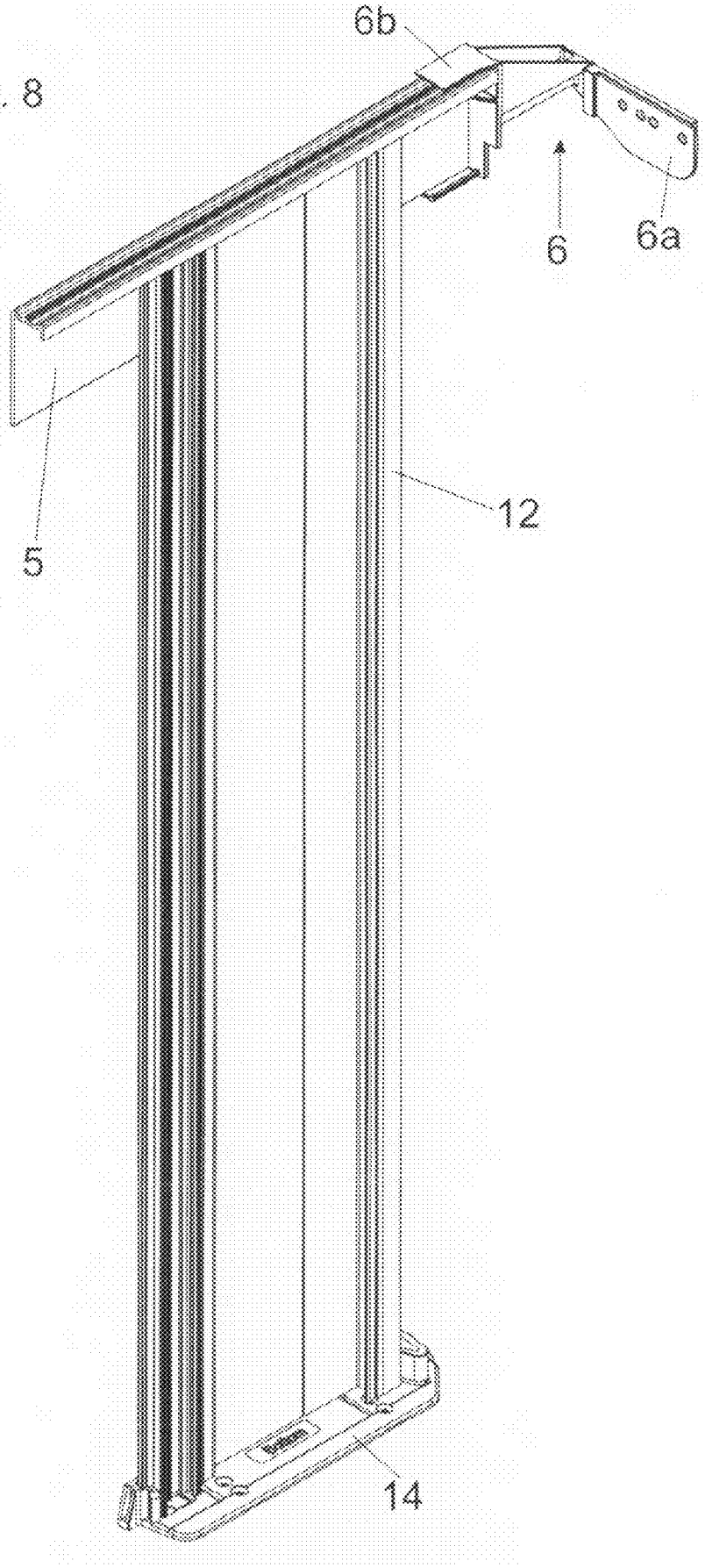
FIG. 8 shows a further embodiment with a base portion for the carrier rail which is to be fixed to the bottom of the cupboard.

FIG. 8 shows a further embodiment of the invention, wherein the holding portions 6 as shown in FIG. 1 through FIG. 4 are provided for fixing to the carcass rail 3*a*. Extending between the holding portions 6 is a transverse bearer 5 in the form of a profile rail, to which a carrier rail 12 which extends perpendicularly in the assembled position, for mounting the respective furniture drives 4, can be fitted by snap engagement. In this case, in contrast to FIG. 6, there is no transverse bearer 5' at the bottom end. Instead of the transverse bearer 5' near the bottom, there is a base portion 14 having a releasable snap-action connection for the carrier rail 12, the base portion 14 being screwed to the bottom of the cupboard of the furniture item 1.

The invention is not limited to the illustrated embodiments, and embraces or extends to all variants and technical equivalents which can be embraced by the scope of the claims hereinafter. The positional details adopted in the description, such as for example upper, lower, lateral and so forth are also related to the immediately described and illustrated Figure and upon a change in position are to be appropriately converted to the new position.

The invention claimed is:

1. A furniture item comprising:

pull-out guide assemblies for supporting and guiding a movable furniture part;

a furniture drive for moving the movable furniture part with respect to a furniture body; and a support construction configured to be mounted to a rear end of the pull-out guide assemblies for fixing said furniture drive in the furniture body, said support construction including:

two substantially L-shaped lateral holding portions; and a rigid transverse bearer extending between said two holding portions, each of said holding portions having a fixing device for fixing said holding portions to a respective one of said pull-out guide assemblies, wherein each of said holding portions has a lateral portion fixed to a respective one of said pull-out guide assemblies, and a transverse portion projecting substantially at a right angle from said lateral portion and connected to said transverse bearer a snap-action connection device for detachably snapping said transverse bearer to said holding portions.

2. The furniture item of claim 1, wherein each of said pull-out guide assemblies has a carcass rail to be fixed to the furniture body, and at least one extension rail to be fixed to the movable furniture part, said holding portions being fixed to said carcass rail.

3. The furniture item of claim 2, wherein said holding portions are configured to be mounted to a rear end of said carcass rail of a respective one of said pull-out guide assemblies.

4. The furniture item of claim 1, wherein said fixing device comprises at least one of a group consisting of a screw connection and a mechanical latching connection.

5. The furniture item of claim 1, wherein said furniture drive is mounted on said transverse bearer.

6. The furniture item of claim 1, wherein a substantially perpendicularly extending carrier rail is fixed to said transverse bearer, said furniture drive being mounted on said carrier rail.

7. The furniture item of claim 6, wherein said furniture drive comprises one of at least two furniture drives mounted to said carrier rail.

8. The furniture item of claim 6, wherein said carrier rail has a length such that said carrier rail extends substantially over an entire height of the furniture body.

9. A furniture item comprising a furniture body:

pull-out guide assemblies for supporting and guiding a movable furniture part;

a furniture drive for moving the movable furniture part with respect to a furniture body; and a support construction configured to be mounted to a rear end of the pull-out guide assemblies for fixing said furniture drive in the furniture body, said support construction including:

two substantially L-shaped lateral holding portions; and a rigid transverse bearer extending between said two holding portions, each of said holding portions having a fixing device for fixing said holding portions to a respective one of said pull-out guide assemblies, wherein each of said holding portions has a lateral portion fixed to a respective one of said pull-out guide assemblies, and a transverse portion projecting substantially at a right angle from said lateral portion and connected to said transverse bearer by a snap-action connection device for detachably snapping said transverse bearer to said holding portions.

10. The furniture item of claim 9, wherein each of said pull-out guide assemblies has a carcass rail to be fixed to the furniture body, and at least one extension rail to be fixed to the movable furniture part, said holding portions being fixed to said carcass rail.

11. The furniture item of claim 10, wherein said holding portions are configured to be mounted to a rear end of said carcass rail of a respective one of said pull-out guide assemblies.

12. The furniture item of claim 9, wherein said fixing device comprises at least one of a group consisting of a screw connection and a mechanical latching connection.

13. The furniture item of claim 9, wherein said furniture drive is mounted on said transverse bearer.

14. The furniture item of claim 9, wherein a substantially perpendicularly extending carrier rail is fixed to said transverse bearer, said furniture drive being mounted on said carrier rail.

15. The furniture item of claim 14, wherein said furniture drive comprises one of at least two furniture drives mounted to said carrier rail.

16. The furniture item of claim 14, wherein said carrier rail has a length such that said carrier rail extends substantially over an entire height of the furniture body.

17. A furniture item comprising:

a furniture body having a rear side;

a movable furniture part configured to be movable relative to said furniture body;

pull-out guide assemblies mounted on said furniture body for supporting and guiding said movable furniture part;

a furniture drive for moving said movable furniture part with respect to said furniture body; and a support construction configured to be mounted to a rear end of the pull-out guide assemblies for fixing said furniture drive in said furniture body, said support construction including:

two substantially L-shaped lateral holding portions; and a rigid transverse bearer extending between said two holding portions and spaced from said rear side of said furniture body, each of said holding portions having a fixing device for fixing said holding portions to a respective one of said pull-out guide assemblies, wherein each of said holding portions has a lateral portion fixed to a respective one of said pull-out guide assemblies, and a transverse portion projecting substantially at a right angle from said lateral portion and connected to said transverse bearer by a snap-action connection device for detachably snapping said transverse bearer to said holding portions.

18. The furniture item of claim 17, wherein each of said pull-out guide assemblies has a carcass rail fixed to said furniture body, and at least one extension rail fixed to said movable furniture part, said holding portions being fixed to said carcass rail.

19. The furniture item of claim 18, wherein said holding portions are configured to be mounted to a rear end of said carcass rail of a respective one of said pull-out guide assemblies.

* * * * *